United States Patent [19]

Bissett

[11] Patent Number: 4,811,026

[45] Date of Patent: Mar. 7, 1989

[54] MOBILE SATELLITE RECEIVING ANTENNA ESPECIALLY FOR RECREATION VEHICLE

[76] Inventor: William R. Bissett, 57544 Sunnyslope Dr., Yucca Valley, Calif. 92284

[21] Appl. No.: 120,657

[22] Filed: Nov. 16, 1987

[51] Int. Cl.[4] ..... H01Q 1/32

[52] U.S. Cl. ..... 343/766; 343/714; 343/840

[58] Field of Search ..... 343/713, 714, 766, 781 P, 343/781 CA, 781 R, 840, 765

[56] References Cited

U.S. PATENT DOCUMENTS

| | | | |
|---|---|---|---|
| 2,334,856 | 11/1943 | Atkinson | 296/95 R |
| 3,412,404 | 11/1968 | Bergling | 343/714 |
| 4,080,603 | 3/1978 | Moody | 343/712 |
| 4,101,897 | 7/1978 | Morrison | 343/715 |
| 4,309,708 | 1/1982 | Sayovitz | 343/713 |
| 4,663,633 | 5/1987 | Wilson | 343/840 |

FOREIGN PATENT DOCUMENTS

| | | | |
|---|---|---|---|
| 2204448 | 8/1973 | Fed. Rep. of Germany | 343/715 |
| 3522404 | 1/1987 | Fed. Rep. of Germany . | |
| 0053903 | 4/1980 | Japan . | |
| 0233905 | 11/1985 | Japan . | |
| 0260205 | 12/1985 | Japan | 343/713 |
| 0260207 | 12/1985 | Japan | 343/713 |

*Primary Examiner*—William L. Sikes
*Assistant Examiner*—Doris J. Johnson
*Attorney, Agent, or Firm*—Harvey S. Hertz

[57] ABSTRACT

A satellite transmission receiving antenna with unique mounting provisions for a recreational vehicle roof. A generally cylindrical collar extends upward from the vehicle roof and attaches to a load distributing panel under the collar and over the area of the vehicle roof for load distribution. A parabolic reflector is hinged along an edge to a generally horizontal turntable within the collar so that the reflector may be rotated to a concave downward position to act as a weather cover over the collar and also to provide smooth aerodynamic conditions during transport. Rotation of the turntable through a motor driven gear coupling to the turntable effects azimuth positioning of the antenna and elevation angle is set by a linear actuator.

10 Claims, 2 Drawing Sheets

FIG. 1
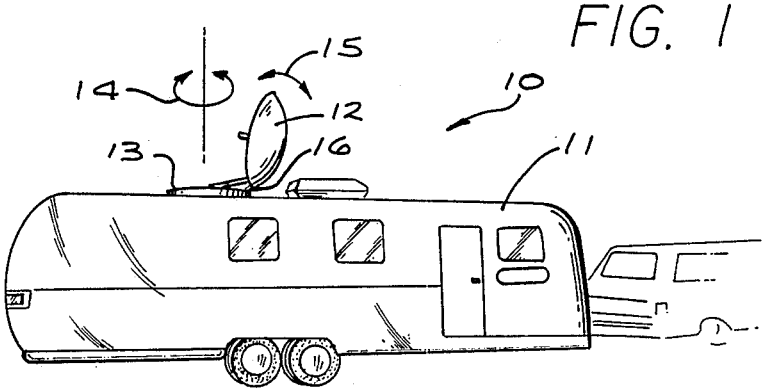
FIG. 2
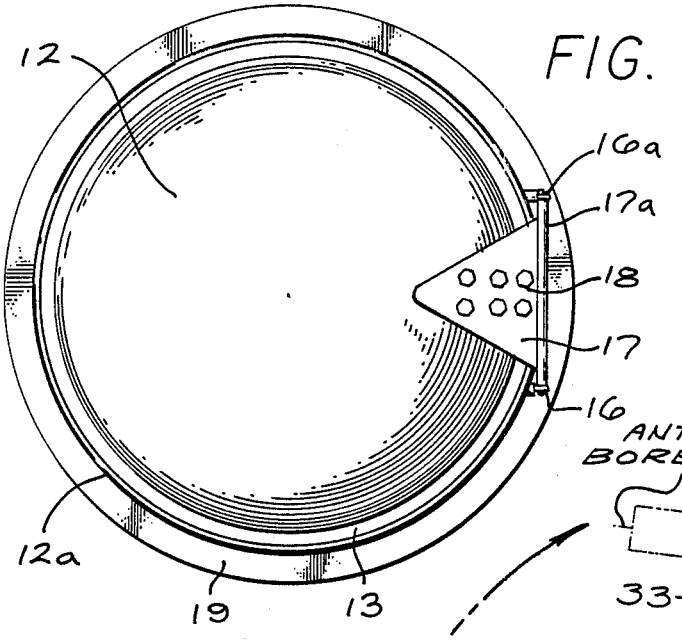
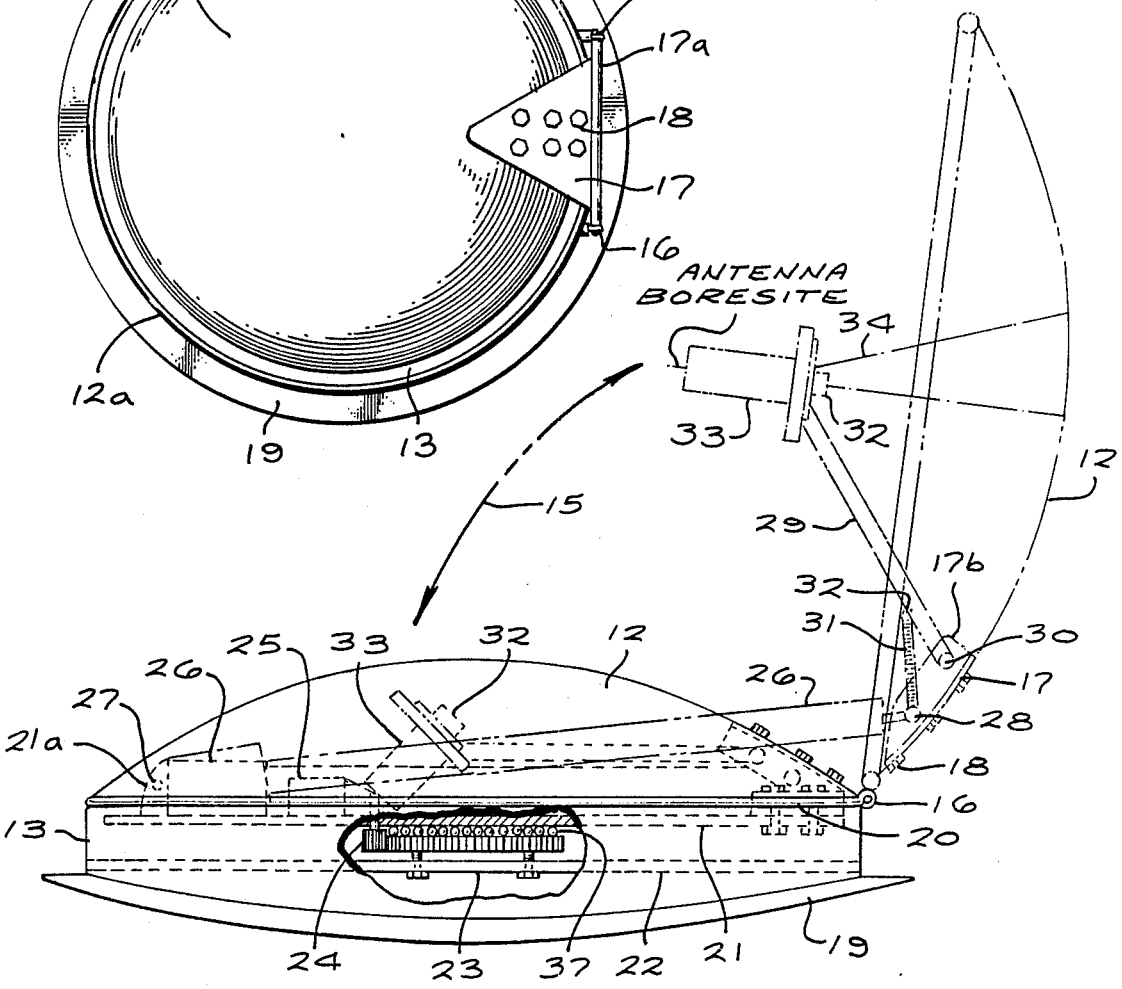
FIG. 3

MOBILE SATELLITE RECEIVING ANTENNA ESPECIALLY FOR RECREATION VEHICLE

BACKGROUND OF THE INVENTION

1. Field of the Invention

The invention relates to antennas generally, and more specifically, to microwave dish-type receiving antennas for recreational vehicle use.

2. Description of the Prior Art

In the prior art, the mounting of antennas on vehicles has been variously addressed. It has been recognized that, during transport, it is highly desirable for an antenna structure to be oriented from its operating position to a position affording reduced air resistance and reduced potential for damage from overhanging trees and other objects.

One prior art arrangement for use with a relatively simple vertical antenna to lower it to a horizontal position is shown in U.S. Pat. No. 4,101,897. Although that disclosure does not apply to the field of invention addressed by the invention, it does serve to show recognition of the desirability of re-orienting vehicle-mounted antennas generally, during transport.

German patent No. 2,204,448 entitled "mobile Satellite Tracking Aerial" shows structures for re-orienting a microwave dish-type antenna into a housing for transport but does not make use of the reflector dish to close the housing as contemplated by the invention.

The state of the art in transportability augmentation for dish type antenna systems is further shown by U.S. Pat. No. 4,309,708. In that disclosure the dish is broken into halves for transport, but no housing structure for it is provided.

Another arrangement for "stowing" a dish type antenna for transport is disclosed in U.S. Pat. No. 3,412,404. In that disclosure, the dish antenna is simply directed downward to make it less subject to interferences from tree branches, low bridges, etc., as it is transported on the vehicle to which it is mounted.

Dish type antennas are common in the radar art, and in recent years have found use in television receiving systems where the signal is received from a geosynchronous satellite. Some of the aforementioned references contemplate radar applications where heavier structures and scanning mechanisms are usually incorporated. The satellite receiving application, on the other hand, does not include continuous scanning, but does require azimuth and elevation orientation mechanisms for accurate and stable direction of the boresite of the antenna toward the satellite.

Another arrangement for downwardly reorienting a vehicle mounted, satellite communication, dish type antenna for transport is shown in Japanese patent No. 55-53903(A). As with the other aforementioned references, no structures for weather protection or significant reduction of wind resistance during transport are shown or intended.

With the increasing popularity of television satellite reception systems, there has been a tendency to apply the available technology in connection with recreational vehicles. Such vehicles also have achieved considerable popularity and accordingly, a need has developed for practical, inexpensive and readily adaptable systems for dish antenna installation on recreational vehicles so that the vacationer/traveller can enjoy satellite-transmitted television programs. The parabolic reflector dish with feed at its focus is widely used for the purpose because of its high gain and discrete beam characteristics. State of the art low noise preamplification is also commonly located at the feed point. In remote areas (away from metropolitan centers), there is often no other television reception available.

Certain recreational vehicles, notably the so-called "house trailer", are constructed with great attention to lightness and are aerodynamically designed to permit towing at highway speeds without excessive fuel consumption by the towing vehicle. One popular "house trailer" has an aluminum outer skin laterally rounded with generally light-weight supporting structures. For mounting even light weight antenna structures on such vehicles, it is important to distribute the resulting roof load over an area rather than relying on point load mountings. Such point mounting can easily result in progressive damage to the roof and water leaks at the mounting points.

The manner in which the invention advances the art in the described field will be understood as this description proceeds.

SUMMARY OF THE INVENTION

In view of the shortcomings of the prior art, it may be said to have been the general object of the invention to produce an inexpensive, light-weight, directable, dish antenna assembly for vehicle, (especially recreational vehicle), roof mounting. The assembly has a load spreading flange or bed plate contoured to the vehicle roof shape for load distribution and employs the reflector dish as an enclosure cover when it is folded down in the non-operative mode or for transport.

A generally cylindrical collar connects to the load distributing flange or bed plate and acts with the folded down reflector dish to form an esthetically pleasing housing having relatively good aerodynamic characteristics. Within the collar and peripherally attached to it, is a support plate preferably spaced above the flange or bed plate, the latter being is in contact with the roof skin of the vehicle.

A distributed bearing supports a turntable from the support plate and a cylindrical gear is fixed to the support plate. A conventional geared motor attached to the turntable drives a pinion gear engaging the cylindrical gear to effect selective rotation of the turntable. The reflector dish is hinged at a peripheral edge to a peripheral location on the turntable enabling elevation angle orientation of the dish boresite controlled by a linear actuator also mounted on the turntable. Azimuth orientation of the dish boresite is produced by the aforementioned controlled rotational positioning of the turntable.

A conventional microwave horn or dipole element serves as a feed and is held substantially at the focus of the normally parabolic reflector dish by an arm and tension cord arrangement.

The feed assembly is also supported by an arm hinged to a point within the reflector dish so that the horn assembly weight and spring tension tend to rotate this arm downward (in the erected reflector dish condition) with restraint by the aforementioned tension cord, thereby to hold the horn assembly substantially at the focus of the reflector dish.

The details of a typical embodiment according to the invention will be described as this specification proceeds.

BRIEF DESCRIPTION OF THE DRAWINGS

FIG. 1 is a pictorial of the antenna system according to the invention mounted on a typical recreation vehicle of the house trailer type.

FIG. 2 is a top view of the assembly according to the invention with the reflector dish folded down to form the housing enclosure for transport.

FIG. 3 is a view of the assembly according to the invention illustrating erected and folded positions of the reflector dish.

DETAILED DESCRIPTION

Figure 4:
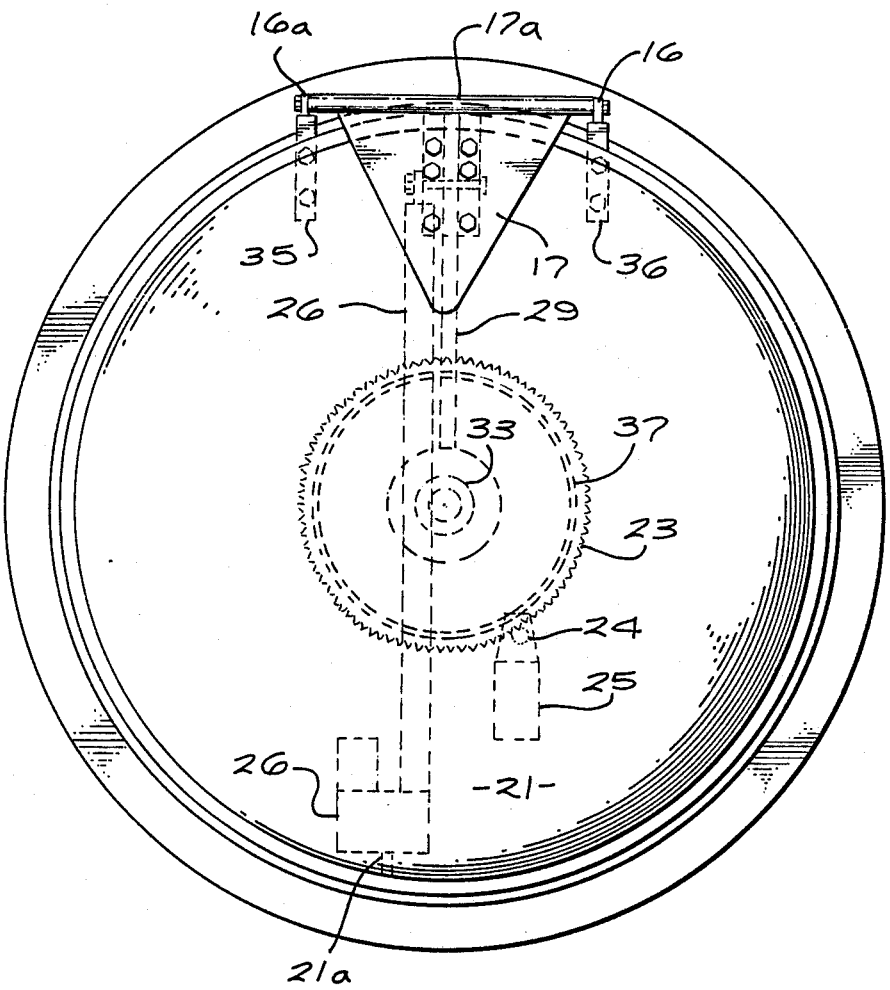
FIG. 4 is a top view of the folded assembly with azimath and elevation control actuators illustrated in phantom.

Referring now to the drawings, FIG. 1 illustrates an arrangement 10 wherein an antenna system 12 according to the invention is mounted on a typical house trailer (vehicle) 11. A parabolic reflector dish 12 is of known type per se. A generally cylindrical collar 13 is seen and it will be apparent that folding down of the dish 12 about a hinge point 16 over the upper edge of the collar 13 will produce a housing enclosing the functional structure of the assembly.

In FIG. 2, the top view presented shows the cover (back surface of the dish 12) after it has been folded down over the top edge of the collar 13. The edge 12*a* of the dish 12 is normally circular and the top of the collar 13 is likewise circular. A gusset 17 is affixed to the back of the dish 12, typically with bolts 18 depicted in FIG. 2. The hinge points 16 and 16*a* are spaced as shown. A tubular sleeve 17*a*, an integral part of gusset 17, fits over a rod anchored to the turntable (to be described). This provides lateral hinge stability in both the erected mode of dish 12 and its folded position.

In FIG. 3, a gusset 20, similar to the gusset 17 may be bolted or otherwise firmly attached to a turntable 21. Alternatively, straps 35 and 36 (see FIG. 4) may be employed. The gusset 20 preferably has ears adjacent to hinge points 16 and 16*a* for supporting the rod understood to be slip-fitted through a sleeve 17*a* (see FIG. 2 also) completing the hinge assembly.

In FIGS. 2 and 3 a bed plate whose flange 19 will be seen to provide load distribution over the roof of vehicle 11. The bed plate flange 19 is only the externally visible portion of a preferably continuous bed plate contoured to fit snuggly over the roof surface of vehicle 11 for optimum load distribution, although the bed plate may cover only a part of the vehicle roof area if a somewhat stronger vehicle roof structure is extant.

Support plate 22 is firmly attached to or integral with the collar 13. Fixed cylindrical gear 23 is bolted or otherwise affixed to support plate 22. This gear 23 has peripheral gear teeth as shown, engaged by pinion gear 24 driven by a conventional right angle output reduction gear motor 25. The reduction gear motor 25 is mounted on the turntable 21 and, therefore, effects rotary positioning of it and consequently produces the azimuth orientation of the antenna assembly boresite.

In FIG. 3, it will be realized that gusset plate 17 includes a normal rib 176 affording rotational connections of linear actuator 26 at pin 28 and feed support arm 29 at pin 30. Linear actuator 26 is also mounted with similar rotational freedom at pin 27 through a normal rib 21*a* extending upward from turntable 21. The action of the linear actuator 26 in erecting or folding down the reflector dish 12 is accomplished by its lengthening or shortening in a conventional, well-known manner. To erect the dish 12 and feed 32, linear actuator 26 is extended, to fold dish 12 downward in the alternate position also shown in FIG. 3, linear actuator 26 is shortened.

It is intended that dish 12 be erectable from the folded (downwardly concave) position to a point approaching 180° to direct the antenna boresite substantially to the zenith. At elevation angle positions of antenna boresite not exceeding a nominal angle, (for example 45°), the weight of the feed 32 and the commonly employed low-noise preamplifier 33 would tend to bias feed support arm 29 downwardly and cord 34 is accordingly in tension for stabilizing the feed aperture at 32 in alignment with the focal point of the reflector dish 12. If a greater antenna boresite angle is required, resilient means such as tension spring 31 would also be required.

Referring now to FIG. 4, previously identified and described parts of the system are shown in phantom within the enclosure formed by the folded down reflection dish. The linear actuator 26 and the feed support arm, along with the feed itself and the preamplifier are shown as they would be nested for transport. Similarly, the azimuth drive 25 is shown as it lies under and attached to the turntable where pinion gear 24 engages the distributed gear 23. As previously indicated, this distributed gear 23 is mounted on the stationary support plate 22.

The straps 35 and 36 are those mounting the hinge assembly at 17*a* and gusset 17 to the back of reflector dish 21.

The distributed bearing 37 shown in FIG. 3 and FIG. 4 provides more stable support for the turntable than would have been possible with a more conventional arrangement, i.e. smaller diameter bearing with a spindle therethrough. The showing of bearing 37 as a series of bearing balls (FIG. 3) is symbolic and omits bearing race parts which are obviously required to keep the bearing intact and prevent lateral shifting of the turntable within the collar 13.

Concerning materials for constructing the assembly according to the invention, the choices will be evident to the person of ordinary skill in this art. The collar 13 and bed plate 19 may be integrally moulded from a high strength material. The reflector dish 12 may be of aluminum or one of its alloys, but also may be of a moulded plastic material with a metallized inside surface.

The cable 34, which stows randomly when the reflector dish is folded down, is preferably of a low dielectric loss plastic material, since it is within the electromagnetic near field of the antenna system.

Electrical connections have been omitted from the drawings, however, these are entirely conventional per se. A connection, usually a coaxial cable connects to the feed preamplifier and electrical power connections and appropriate switching are required for azimuth and elevation control apparatus.

Various modifications and common mechanical variations will suggest themselves to those of skill in this art once the inventive concepts are appreciated. Accordingly, it is not intended that the scope of the invention should be regarded as limited to the specifics of the drawings and this description, these being intended to be illustrative only.

I claim:

1. A vehicle mounted reflector dish antenna assembly for reception of microwave signals from a geosynchronous satellite, comprising:

first means including a generally cylindrical collar having a top circumference shape substantially matching the peripheral circumference and shape of said reflector dish, said collar being contoured along its bottom edge to conform to the shape of said vehicle roof;

second means for controlling the azimuth angle of the boresite of said reflector dish;

third means for controlling the elevation angle of said reflector dish boresite toward said satellite and for folding said reflector into a downward-facing position against said collar top shape to form an enclosure during transport of said vehicle.

2. The combination according to claim 1 in which said second means includes a turntable within the interior of said collar and mounted over a bearing, said bearing being supported with respect to structure associated with said collar.

3. The combination according to claim 2 in which said second means further includes a gear surface coaxial and radially outward from said bearing, said gear surface being supported with respect to structure associated with said collar, and a reduction geared drive motor mounted on said turntable and having an output pinion gear engaging said gear surface to effect azimuth positioning of said turntable.

4. The combination set forth in claim 3 in which said structure associated with said collar includes a support plate within the interior of said collar, said support plate being attached to the interior surface of said collar.

5. The combination set forth in claim 2 in which hinge means are provided at said lower edge of said reflector to hinge said reflector dish to an adjacent point along the perimeter of said turntable, said lower edge of said reflector being identified when said reflector dish is in an operating position.

6. The combination according to claim 5 in which a linear actuator is provided and is operative between a point adjacent said reflector dish lower edge and a substantially diametrically opposite point adjacent the perimeter of said turntable.

7. The combination according to claim 1 further comprising a load distributing sheet affixed to said collar bottom edge, said load distributing sheet being shaped to be in substantial contact with said vehicle roof over at least a portion of the area of said roof beneath said collar, thereby to distribute the weight of said antenna assembly over a substantial area of said vehicle roof.

8. A vehicle mounted parabolic reflector dish antenna assembly for reception of microwave signals from a geosynchronous satellite, comprising:

first means including a generally cylindrical collar having a top circumference shape substantially matching the peripheral circumference and shape of said reflector dish, said collar being contoured along its bottom edge to conform to the shape of said vehicle roof;

second means including a load distributing sheet affixed to said collar bottom edge, said load distributing sheet being contoured to be in substantial contact with said vehicle roof over at least a portion of the area of said roof beneath said collar, thereby to distribute the weight of said antenna assembly over a substantial area of said vehicle roof;

third means for selectively controlling the azimuth angle of the boresite of said reflector dish;

fourth means for selectively controlling the elevation angle of said reflector dish boresite and for folding said reflector dish downward to a position concave downward over the top of said collar to form an enclosure for transport;

fifth means comprising an antenna feed and means for locating said feed substantially at the focus of said parabolic reflector dish, said fifth means including a feed support and extending from said feed and hinged to a lower edge of said reflector, said rod extending upward at an angle when said reflector dish is in an operating position; and sixth means consisting of a flexible dielectric cable extending from a point in the concave surface of said reflector dish to said feed.

9. The combination according to claim 8 in which said third means includes a turntable within the interior of said collar and mounted over a bearing, said bearing being supported with respect to structure associated with said collar.

10. The combination according to claim 8 in which said third means further includes a gear surface coaxial and radially outward from of said bearing, said gear surface being supported with respect to structure associated with said collar, and a reduction geared drive motor mounted on said turntable and having an output prior gear engaging said gear surface to effect azimuth positioning of said turntable.

* * * * *